US010294903B2

(12) United States Patent
Zaharias et al.

(10) Patent No.: US 10,294,903 B2
(45) Date of Patent: May 21, 2019

(54) FUEL SUPPLY SYSTEM

(71) Applicant: MAN DIESEL & TURBO SE, Augsburg (DE)

(72) Inventors: Manuel Zaharias, Augsburg (DE); Markus Stopfer, Augsburg (DE); Andreas Stichnoth, Augsburg (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 15/726,657

(22) Filed: Oct. 6, 2017

(65) Prior Publication Data

US 2018/0106226 A1 Apr. 19, 2018

(30) Foreign Application Priority Data

Oct. 18, 2016 (DE) ..... 10 2016 119 811

(51) Int. Cl.

| | |
|---|---|
| ***F02M 55/00*** | (2006.01) |
| ***F02M 55/02*** | (2006.01) |
| ***F02M 59/46*** | (2006.01) |
| ***F02M 65/00*** | (2006.01) |
| ***F02M 63/02*** | (2006.01) |
| ***F02M 63/00*** | (2006.01) |

(52) U.S. Cl.

CPC ..... *F02M 55/002* (2013.01); *F02M 55/00* (2013.01); *F02M 55/025* (2013.01); *F02M 59/46* (2013.01); *F02M 63/0003* (2013.01); *F02M 63/0285* (2013.01); *F02M 65/006* (2013.01)

(58) Field of Classification Search

CPC .... F02M 55/002; F02M 55/00; F02M 65/006; F02M 55/025; F02M 59/46; F02M 63/003; F02M 63/0285

See application file for complete search history.

(56) References Cited

U.S. PATENT DOCUMENTS 5,773,716 A * 6/1998 Antonioli ..... F02B 77/08 701/103
2005/0103312 A1* 5/2005 Uchiyama ..... F02D 41/221 123/457

(Continued)

FOREIGN PATENT DOCUMENTS

DE 101 57 135 6/2003
DE 10 2013 000 606 7/2014

*Primary Examiner* — Thomas N Moulis
(74) *Attorney, Agent, or Firm* — Cozen O'Connor

(57) ABSTRACT

A fuel supply system having a low pressure region, a pumping device to deliver fuel from the low pressure region to a high pressure region. In the high pressure region between the pumping device and injectors there is a pressure storage system that is permanently under high pressure. The pressure storage system has a plurality of distributor units each with at least three connections connected in series. A respective injector connection of each distributor unit is connected to at least one injector each via a high pressure line that is under high pressure at times dependent on the injection cycle. Each distributor unit of the pressure storage system is assigned an individual leakage detection device. Each distributor unit is assigned a non-return valve, which allows a leakage flow starting out from the respective distributor unit in the direction of the pumping device.

12 Claims, 2 Drawing Sheets

(56) References Cited

U.S. PATENT DOCUMENTS

| | | | | |
|---|---|---|---|---|
| 2006/0130560 | A1* | 6/2006 | Shamine | F02M 55/002 73/40 |
| 2010/0288018 | A1* | 11/2010 | Hopmann | F02M 55/002 73/40.5 R |
| 2012/0006297 | A1* | 1/2012 | Worthington | F02M 37/0052 123/456 |

* cited by examiner

FUEL SUPPLY SYSTEM

BACKGROUND OF THE INVENTION

1. Field of the Invention

The invention relates to a fuel supply system of an internal combustion engine.

2. Description of the Related Art

FIG. 1 shows the fundamental construction of a common rail fuel supply system of an internal combustion engine known from the prior art, namely a marine diesel engine operated with heavy fuel oil. This construction is known from DE 101 57 135 B4. Accordingly, the common rail fuel supply system of FIG. 1 comprises at least one injector 1 for each cylinder of the internal combustion engine. By way of the injectors 1, the fuel is injectable into each of the cylinders of the internal combustion engine. The common rail fuel supply system furthermore comprises a pumping device 3 having at least one low pressure pump 5, at least one high pressure pump 2 and a high pressure pump storage unit 8, in order to deliver fuel from a low pressure region 4 of the common rail fuel supply system into a high pressure region 6 of the same, wherein in the high pressure region 6 between the pumping device 3 and the injectors 1 a pressure storage system 7 that is permanently under high pressure is provided. The pressure storage system 7 that is permanently under high pressure, which is also called common rail, has a plurality of distributor units 9. The distributor units 9 are connected to the pumping device 3 and among themselves via high pressure lines 10 that are permanently under high pressure. The pressure storage system 7, namely the distributor units 9, are furthermore connected to the injectors 1 via high pressure lines 11 that are under high pressure at times depending on the injection cycle. The high pressure lines 11, which are under high pressure at times dependent on the injection cycle that connect the injectors 1 to the distributors 9, are assigned switching valves 12, which, dependent on the injection cycle, feed fuel to the injectors. With regard to further details, reference is made to DE 101 57 135 B4.

Such a fuel supply system of an internal combustion engine known from the prior art has a multiplicity of sealing points in the high pressure region 6, in particular in the region of the pressure storage system 7, which comprises the distributor units 9 that are coupled via the high pressure lines 10. In the region of these sealing points leakages can occur. When a leakage quantity becomes excessive, an orderly operation of the fuel supply system can no longer be ensured. Furthermore, the high pressure lines 10 as such can be damaged which can likewise cause an impermissibly high leakage. It is known to embody the high pressure lines 10 as jacketed high pressure lines 10 in order to discharge the leakage via jacket tubes of the high pressure lines 10, namely from distributor unit 9 to distributor unit 9 up to the region of the pumping device 3.

From DE 10 2013 000 606 A1 a further fuel supply system of an internal combustion engine is known. According to the prior art, all distributor units of the pressure storage system are connected to a common leakage collection line with a leakage sensor that is common for all distributor units to detect a leakage quantity that exceeds a limit value. Furthermore, each distributor unit of the pressure storage system is assigned an individual leakage detection device designed as a visual inspection device, to assign the leakage detected via the leakage sensor to at least one distributor unit.

Although in the fuel supply system known from DE 10 2013 000 606 A1 a time needed for the leakage detection and assigning of the leakage can be reduced, there is a need for a fuel supply system with which the exact assignment of a leakage to a distributor unit of the fuel supply system can take place even faster, more efficiently and reliably.

SUMMARY OF THE INVENTION

One aspect of the present invention is based on creating a new type of fuel supply system of an internal combustion engine, with which the assignment of a leakage to a distributor unit can take place quickly, efficiently, and reliably.

According to one aspect of the invention, each distributor unit is assigned a non-return valve that allows a leakage flow starting out from the respective distributor unit in the direction of the pumping device but prevents flow in the opposite direction.

Through the non-return valves it is ensured that a leakage flow starting out from a respective distributor unit always flows in the direction of the pumping device but not in the opposite direction in the direction of a distributor unit directly located downstream of the respective distributor unit. By way of this, the actual leakage detection or the actual assignment of the leakage to one of the distributor units can take place significantly faster and more reliably than is the case with the fuel supply system known from DE 10 2013 000 606 A1.

According to an advantageous further development of the invention, each respective non-return valve is assigned to the fuel drain connection of the respective distributor unit, wherein the respective non-return valve allows a leakage flow starting out from the respective fuel drain connection of the respective distributor unit in the direction of the individual leakage detection device of the respective distributor unit. This configuration is particularly preferred for a reliable and fast assignment of a leakage to a distributor unit of a fuel system having a plurality of distributor units.

According to a further advantageous further development of the invention, the respective individual leakage detection device is coupled to the fuel feed connection, the fuel drain connection and the injector connection of the respective distributor unit. The respective non-return valve is connected between the fuel drain connection and the individual leakage detection device of the respective distributor unit, however not connected between the fuel feed connection and the individual leakage detection device of the respective distributor unit nor between the injector connection and the individual leakage detection device of the respective distributor unit. By way of this it is also possible to assign a leakage in a fuel supply system easily and reliably to a distributor unit of a fuel supply system having a plurality of distributor units.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description.

Exemplary embodiments of the invention are explained in more detail by way of the drawing without being restricted to this. There it shows.

DETAILED DESCRIPTION OF THE PRESENTLY PREFERRED EMBODIMENTS

The invention present here relates to a fuel supply system, in particular a common rail fuel supply system, an internal combustion engine in particular designed as large diesel engine or marine diesel engine.

Figure 1:
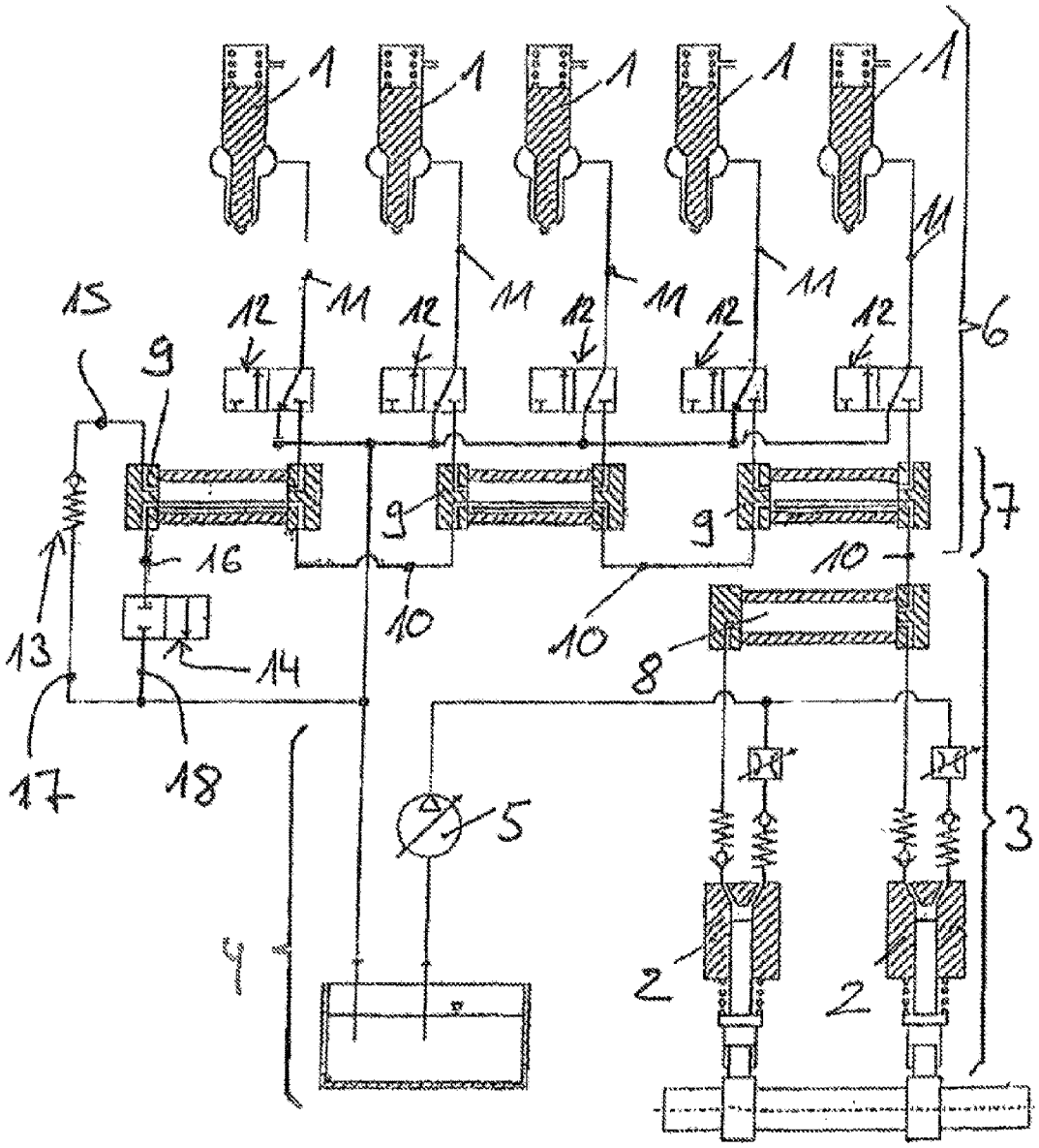
FIG. 1 PRIOR ART
FIG. 1: is a diagram of a fuel supply system known from the prior art.

The fundamental structure of such a fuel supply system has already been described making reference to FIG. 1. The invention present here now relates to such details of the fuel supply system which make possible a safe and reliable assignment of a leakage in the high pressure region 6, namely in the pressure storage system 7, to a distributor unit 9 of the fuel supply system.

Figure 2:
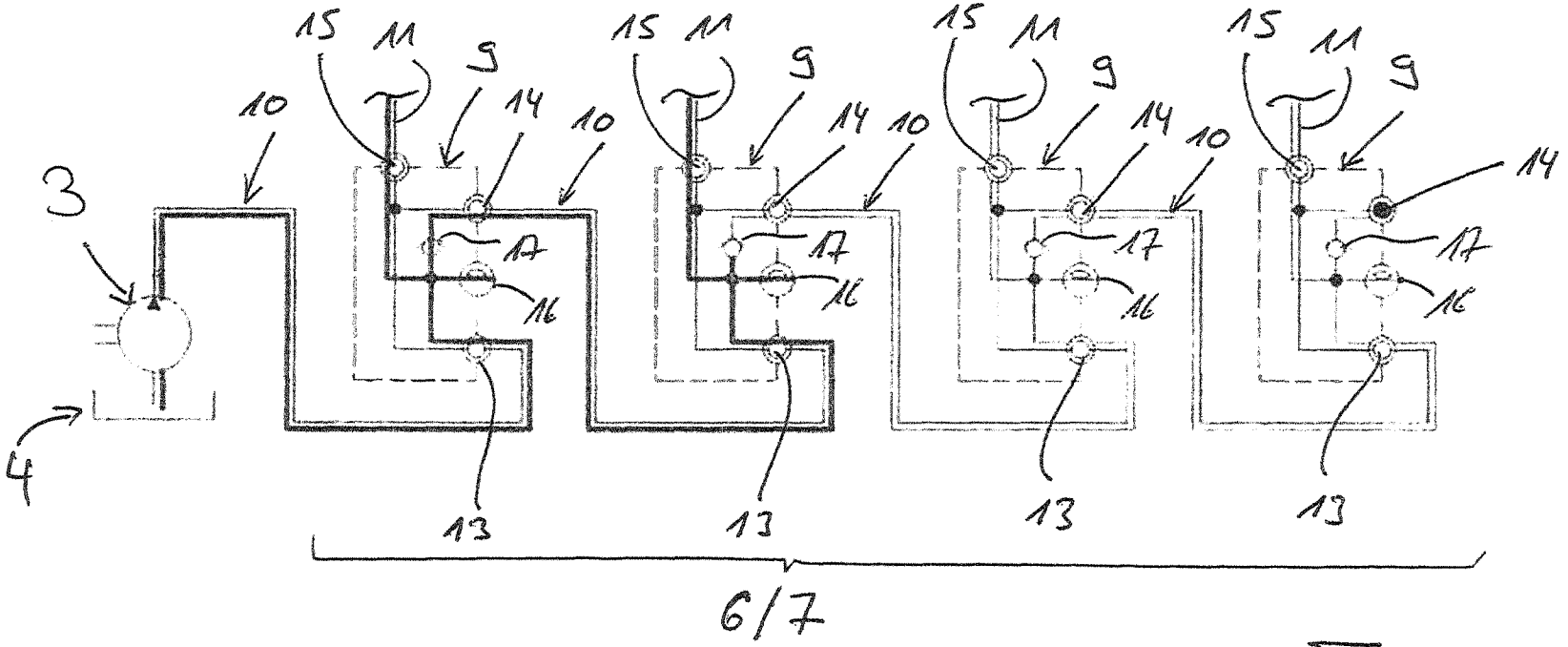
FIG. 2: is an extract from a fuel supply system according to the invention.

FIG. 2 shows a schematic extract from a fuel supply system according to the invention in the region of the pressure storage system 7 of the high pressure region 6, wherein a pressure storage system 7 with four distributor units 9 connected in series is shown.

According to FIG. 2, each distributor unit 9 of the pressure storage system 7 has multiple connections, namely at least three connections 13, 14 and 15 in each case. A fuel feed connection 13 of a first distributor unit 9 of the distributor units 9 of the pressure storage system 7 connected in series is connected to the pumping device 3 via a high pressure fuel line 10 that is permanently under high pressure. A fuel drain connection 14 of this first distributor unit 9 and fuel drain connections 14 of further distributor units 9 up to and including the penultimate distributor unit 9 are connected to the fuel feed connection 13 of the respective distributor unit 9 that is directly located downstream likewise via a high pressure line 10 that is permanently under high pressure. Accordingly the fuel drain connection 14 of the first distributor unit 9 is coupled to the fuel feed connection 13 of the second distributor unit 9, the fuel drain connection 14 of the second distributor unit 9 is coupled to the fuel feed connection 13 of the third and penultimate distributor unit 9, wherein the fuel drain connection 14 of the third and penultimate distributor unit 9 is coupled to the fuel feed connection of the fourth and according to FIG. 2 last distributor unit 9. The fuel drain connection 14 of the fourth and in FIG. 2 last distributor unit 9 is closed or plugged.

In addition to the fuel feed connections 13 and the fuel drain connections 14 of the distributor units 9, each distributor unit 9 furthermore has an injector connection 15. The injector connection 15 is in connection with at least one injector 1 each via a high pressure line 11 that is under high pressure at times dependent on the injection cycle.

The fuel lines 10, 11 are in each case jacketed fuel lines constructed in such a manner that an actual high pressure connecting tube is surrounded on the outside by a jacket tube. The respective jacket tube, which surrounds the respective high pressure connection tube of the respective fuel line 10 or 11, serves for discharging leakage.

According to FIG. 2, each distributor unit 9 of the pressure storage system 7 has an individual leakage detection device 16. This individual leakage injection device 16 is preferentially embodied as visual inspection device which serves in order to assign a leakage to a distributor unit 9.

From FIG. 2 it is evident that in the region of each distributor unit 9 the respective individual leakage detection device 16 is coupled to the respective fuel feed connection 13, the respective fuel drain connection 14, and the respective injector connection 15, so that starting out from each of the connections 14, 15, and 16 of the respective distributor unit 9 a leakage can reach the region of the respective individual leakage detection device 16.

According to one aspect of the invention, each distributor 9 is assigned a non-return valve 17, which allows a leakage flow starting out of the respective distributor unit 9 in the direction of the pumping device 3, but prevents an opposite leakage flow starting out from the respective distributor unit 9 in the direction of a distributor unit 9 coupled to the fuel drain connection 14 of the same.

Preferentially, the respective non-return valve 17 of the respective distributor unit 9 is assigned to the fuel drain connection 14 of the respective distributor unit 9 preferentially in such a manner that the respective non-return valve 17 is connected between the fuel drain connection 14 and the individual leakage detection device 15 of the respective distributor unit 9, however neither between the fuel feed connection 13 and the individual leakage detection device 15 nor between the injector connection 15 and the individual leakage detection device 16 of the respective distributor unit 9. The respective non-return valve 17 allows a leakage flow starting out from the respective fuel drain connection 14 of the respective distributor unit 9 in the direction of the individual leakage detection device 16 of the respective distributor unit 9 but prevents a leakage flow from the respective leakage detection device 16 in the direction of the respective fuel drain connection 14.

Although not shown in FIG. 2 it is additionally possible that in accordance with DE 10 2013 000 606 A1 all distributor units 9 are connected to a common leakage collection line, with which a leakage sensor that is common to all distributor units 9 interacts.

Accordingly, with the invention it is proposed that in the region of each distributor unit 9 of the pressure storage system 7 of the fuel supply system a non-return valve 17 is installed. This non-return valve 17 allows a flow in the region of the respective distributor unit 9 via the jacket tubes of the high pressure fuel lines 10 in the direction of the pumping device 3 but prevents a leakage flow in the opposite direction.

As already explained, the fuel leakage flows via the jacket tubes of the respective high pressure fuel lines 10, which surround the actual high pressure tubes of the same.

In the case of a fracture of a high pressure tube of a high pressure fuel line 10, 11 or a leakage in the region of a connection 13, 14, 15 or a leakage in the connecting region between high pressure fuel lines, leakage accordingly can only drain in the direction of the pumping device 3 through the jacket tubes and reach the region of the individual leakage detection device 16 of the distributor units 9.

The respective leakage detection device 16 of that distributor unit 9, which in the line of distributor units 9 has the greatest distance from the pumping device 3 and is filled with leakage, indicates that distributor unit to which the leakage is to be assigned. Then, either a leakage occurs in the region of this distributor unit 9 or in the region of high pressure fuel line 10, which connects this distributor unit 9 with the distributor unit 9 that is directly located upstream of the line of distributor units 9 in the direction of the pumping device 3.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A fuel supply system configured as a common rail fuel supply system of an internal combustion engine comprising:

a low pressure region;

a high pressure region;

a pumping device configured to deliver fuel from the low pressure region to the high pressure region;

a plurality of high pressure lines configured to operate under high pressure;

a pressure storage system configured for high pressure and arranged in the high pressure region between the pumping device and injectors assigned to cylinders of the internal combustion engine;

wherein the pressure storage system has a plurality of serially connected distributor units, each distributor units comprising:

a fuel feed connection;

a fuel drain connection; and a injector connection, wherein:

a fuel feed connection of a first distributor unit is connected to the pumping device via a respective high pressure line, a respective fuel drain connection of the first distributor unit up to a penultimate distributor unit is connected to the fuel feed connection of the respective distributor unit located directly downstream via a respective high pressure line, a fuel drain connection of a last distributor unit is closed, and a respective injector connection of each distributor unit is configured to be connected to at least one of the injectors via a high pressure line that is under high pressure at times dependent on an injection cycle, an individual leakage detection device assigned to each distributor unit a non-return valve assigned to each distributor unit, which allows a leakage flow starting out from the respective distributor unit towards the pumping device.

2. The fuel supply system according to claim 1, wherein each respective non-return valve prevents a leakage flow starting out from the respective distributor unit in opposite direction in the direction of a distributor unit that is located directly downstream of the respective distributor unit.

3. The fuel supply system according to claim 1, wherein each respective non-return valve is assigned to the fuel drain connection of the respective distributor unit.

4. The fuel supply system according to claim 1, wherein the respective individual leakage detection device of each distributor unit is coupled to the fuel feed connection, the fuel drain connection and the injector connection of the respective distributor unit.

5. The fuel supply system according to claim 4, wherein each non-return valve is connected between the fuel drain connection and the individual leakage detection device of a respective distributor unit.

6. The fuel supply system according to claim 5, wherein each respective non-return valve allows a leakage flow starting out from the respective fuel drain connection in a direction of the individual leakage detection device of a respective distributor unit.

7. The fuel supply system according to claim 5, wherein the respective non-return valve of the respective distributor unit is not connected between the fuel feed connection and the individual leakage detection device of a respective distributor unit.

8. The fuel supply system according to claim 5, wherein the respective non-return valve of a respective distributor unit is not connected between the injector connection and the individual leakage detection device of the respective distributor unit.

9. The fuel supply system according to claim 1, wherein each respective individual leakage detection device is a visual inspection device.

10. The fuel supply system according to claim 1, further comprising:

a common leakage connection line with a leakage sensor that is common for all distributor units to which all distributor units of the pressure storage system are connected to detect a leakage rate above a limit value for the pressure storage system as unit.

11. The fuel supply system according to claim 3, wherein the respective individual leakage detection device of each distributor unit is coupled to the fuel feed connection, the fuel drain connection and the injector connection of the respective distributor unit.

12. The fuel supply system according to claim 6, wherein the respective non-return valve of the respective distributor unit is not connected between the fuel feed connection and the individual leakage detection device of a respective distributor unit.

* * * * *